US010181388B1

(12) United States Patent
Hoff

(10) Patent No.: US 10,181,388 B1
(45) Date of Patent: Jan. 15, 2019

(54) CROSSED FIELD DEVICE

(71) Applicant: The United States of America, as represented by the Secretary of the Air Force, Washington, DC (US)

(72) Inventor: Brad W. Hoff, Albuquerque, NM (US)

(73) Assignee: THE UNITED STATES OF AMERICA AS REPRESENTED BY THE SECRETARY OF THE AIR FORCE, Washington, DC (US)

( * ) Notice: Subject to any disclaimer, the term of this patent is extended or adjusted under 35 U.S.C. 154(b) by 0 days.

(21) Appl. No.: 15/789,924

(22) Filed: Oct. 20, 2017

(51) Int. Cl.

| | |
|---|---|
| ***H01J 23/02*** | (2006.01) |
| ***H05H 7/04*** | (2006.01) |
| ***H05H 13/04*** | (2006.01) |
| ***H01J 25/42*** | (2006.01) |
| ***H01J 25/587*** | (2006.01) |
| ***H01J 23/10*** | (2006.01) |
| ***H01J 23/05*** | (2006.01) |

(52) U.S. Cl.
CPC ..... *H01J 25/587* (2013.01); *H01J 23/05* (2013.01); *H01J 23/10* (2013.01)

(58) Field of Classification Search
CPC ..... H01J 25/587; H01J 23/213; H01J 25/50; H01J 23/005; H01J 23/02; H01J 23/22; H01J 2223/05; H01J 2223/12; H01J 2223/14
USPC ..... 315/501, 507, 236, 267
See application file for complete search history.

(56) References Cited

U.S. PATENT DOCUMENTS

| | | | | |
|---|---|---|---|---|
| 7,106,004 | B1 | 9/2006 | Greenwood | |
| 2002/0190656 | A1 * | 12/2002 | Small | H01J 23/213 315/39 |
| 2011/0204785 | A1 | 8/2011 | Gilgenbach et al. | |

OTHER PUBLICATIONS

Franzi, Matthew, et al., Passive mode control in the recirculating planar magnetron, Physics of Plasmas, 2013, American Institute of Physics.
Gilgenbach, Ronald M., et al., Recirculating Planar Magnetrons for High-Power High-Frequency Radiation Generation, IEEE Transactions of Plasma Science, Apr. 2011, vol. 39, No. 4, pp. 980-987.
Greening, Geoffrey B., et al., Multi-frequency recirculating planar magnetrons, Applied Physics Letters, 2016, AIP Publishing.

(Continued)

*Primary Examiner* — Wei Chan
(74) *Attorney, Agent, or Firm* — James M. Skorich

(57) ABSTRACT

A crossed field device for generating electromagnetic emissions includes an anode having a first slow-wave structure having a plurality of first vanes separated by cavities formed therebetween and a second slow-wave structure having a plurality of second vanes separated by cavities formed therebetween. At least one of the first vanes is laterally aligned with one of the second vanes. The first vanes are offset from the second vanes by an offset distance so that at least one of the first vanes is not laterally aligned with a second vane and at least one of the second vanes is not laterally aligned with a first vane. The device further includes a cathode disposed in a space located between first and second vanes. A magnetic element generates a magnetic field (B), which is oriented orthogonally to an electric field (E) formed by the anode and cathode to generate EM emissions.

20 Claims, 14 Drawing Sheets

(56) References Cited

OTHER PUBLICATIONS

Hoff, Brad W., et al., A compact, pi-mode extraction scheme for the axial b-field recirculating planar magnetron, Air Force Research Laboratory, Jul. 23, 2012.
Franzi, Matt, Relativistic Recirculating Planar Magnetrons, Ph. D. Dissertation, University of Michigan, 2014.

* cited by examiner

CROSSED FIELD DEVICE

GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

CROSS-REFERENCE TO RELATED APPLICATIONS

Not Applicable.

FIELD OF THE INVENTION

The present disclosure relates generally to vacuum electronic microwave oscillators. More particularly, this disclosure applies to recirculating planar magnetrons. Specifically, this disclosure relates a device in which the extracted microwave output of the upper and lower sections of a recirculating planar magnetron remain in phase and allows for optimal extraction of microwave power.

BACKGROUND

With initial reference to FIGS. 1 and 2, a recirculating planar magnetron (RPM) 100 is a high-power crossed-field radio frequency (RF) or microwave source that includes a cathode 102 surrounded by an anode 104 for creating a direct current (DC) or quasi-DC electric field (E) applied from the cathode to the anode region. Additionally, magnetic elements 106 are placed on either side of the cathode 102 and anode 104 for creating a magnetic field (B) that is orthogonal to the electric field. Accordingly, as the term is used herein, "crossed field" refers to the fact that a static magnetic field (B) applied to the device and the direct current (DC) or quasi-DC electric field (E) applied from the cathode to the anode regions of the device are generally orthogonal in direction. Microwaves generated within the RPM 100 are directed away from the anode 104 via waveguides 124 to the intended load.

As shown in FIG. 3, the anode 104 includes first and second planar magnetron sections 108, 110, respectively (also referred to herein as the "upper" and "lower" magnetron sections, respectively, as illustrated). Additionally, recirculation sections 112 connect the planar magnetron sections 108, 110 together. Each of the planar magnetron sections 108, 110 contains periodic corrugations comprised of vanes 114 and cavities 116. A "period" of the planar magnetron section is the space or distance required for a structure of the planar magnetron to be repeated. In this case, the period length is equal to the width of one vane 114 and one cavity 116. In this embodiment, the same number of vanes 114 and cavities 116 are placed on each of the planar magnetron sections 108, 110. However, in other embodiments, the number of vanes and cavities on one planar magnetron section may be different from the number of vanes and cavities on the opposite planar magnetron section. This structure of vanes 114 and cavities 116 is often referred to as a "slow wave structure" because of its tendency to slow the velocity of oscillatory electromagnetic (or "EM") waves traveling along the structure to less than the speed of light, which is necessary for the RPM 100 to function.

In FIGS. 4A and 4B, a cross section of a cathode positioned between the first and second planar magnetron sections 108, 110 of the anode 104 is provided. In these images, the recirculation sections have been removed for simplicity. In FIG. 4A, a solid cathode 102' is shown. On the other hand, in FIG. 4B, a segmented cathode 102 having a number of gaps 118 provided along its length is shown. The gaps 118 formed in the segmented cathode 102 are laterally aligned with the cavities 116 formed between the vanes 114 of the upper and lower planar magnetron sections 108, 110. In each case, the electric field (E) and magnetic field (B) are illustrated. The cross product of these two fields results in electrons drifting in the direction shown by $V_{ExB}$ along both sides of the cathode and then around the recirculation sections 112, which results in the creation of microwaves being formed in the cavities 116 of the anode 104.

In RPMs utilizing a solid cathode 102' (FIG. 4A), the first and second planar magnetron sections 108, 110 couple primarily through the recirculation sections located adjacent each of the ends of the cathode. Coupling in this manner can be somewhat weak. As a result, during operation of this type of RPM, it is possible for the electromagnetic RF oscillations in the upper and lower planar magnetron sections 108, 110 to drift in frequency and phase with respect to one another. On the other hand, as shown in FIG. 4B, a segmented or "mode control" cathode 102 provides gaps 118 that enable additional coupling paths to be created between the upper and lower planar magnetron sections 108, 110. Use of a mode control cathode 102 results in better frequency locking and phase stability of the overall device.

One method for extracting microwave power from an RPM requires two adjacent cavities of a magnetron slow wave structure to be coupled together into a single extraction waveguide. To function optimally while utilizing this extraction method, the RPM should operate in "pi mode," which occurs when the RF electric field across each adjacent magnetron cavity differs by 180 degrees (or pi radians). When using a mode control cathode, its modes of operation may be divided into a set of even modes and a set of odd modes and each set of modes has its own pure pi mode (i.e., the set of odd modes will have an odd pi mode and the set of even modes will have an even pi mode). The terms "even" and "odd" are used to denote when the RF oscillations of the upper and lower sections of the RPM are in phase or 180 degrees out of phase, respectively. Because power coupled into waveguides attached to the upper and lower sections of the RPM will be dictated by this phase relationship, the RF energy in the extraction waveguides coupled to the upper RPM section may either be in phase or 180 degrees out of phase with the RF energy in the extraction waveguides coupled to the lower RPM section. As discussed above, the gaps 118 formed in the segmented cathode 102 are laterally aligned with the cavities 116 formed between the vanes 114 of the upper and lower planar magnetron sections 108, 110. This configuration allows the required electromagnetic communication to occur between the upper and lower slow wave structures that allows the device to operate in either the odd pi mode or the even pi mode.

The dispersion diagram shown in FIG. 5 describes the relationship between frequency and phase shift per cavity for a given set of modes. Plotted in the dispersion diagram are curves that represent the frequency and phase shift relationships for the first passband of the even mode 136 and odd mode 138 that occur when a mode control cathode is used. As illustrated by the dispersion diagram, when using a mode control cathode, the strong coupling between upper and lower planar magnetron sections allowed by the gaps in the cathode enhances phase synchronism in the electromagnetic oscillations of the upper and lower planar magnetron sections. As discussed above, use of the mode control cathode splits the first passband into a set of even modes and a set of odd modes. If a solid cathode were to be used, there would be only one curve. The pi mode of each mode set occurs where the phase shift per cavity is equal to 180 degrees or pi radians.

Cross-sectional views of an RPM operating in pi mode are illustrated in FIGS. 6A-6C. In FIG. 6A, an RPM with a solid cathode 102' is illustrated. Coupling of the upper and lower planar magnetron sections 108, 110 of the RPM takes place primarily through the recirculation sections (not shown), as discussed above. The coupling is generally weak and, as a result of this weak coupling, the pi mode oscillations in the upper and lower planar magnetron sections 108, 110 may not be completely synchronized in phase. The upper electron spokes 120 are in a slightly different configuration from the lower electron spokes 122. This indicates that the pi mode oscillations in the upper planar magnetron section 108 are slightly out of phase with the pi mode oscillations in the lower planar magnetron section 110 and, thus, have a different appearance.

On the other hand, FIG. 6B depicts an RPM with a mode control cathode 102 operating in the even pi mode and FIG. 6C depicts an RPM with a mode control cathode operating in the odd pi mode. In this case, the upper and lower electron spokes 120, 122 are significantly more uniform in appearance and shape due to the increased coupling that is made possible by the gaps 118 formed in the segmented cathode 102. The uniformity in shape is an indicator that the upper and lower slow wave structures 108, 110 are locked into the same mode (either the even or odd pi mode) instead of operating in different modes.

Representations of the oscillatory RF electric field 126 for the even pi mode and the odd pi mode are shown in FIGS. 7A and 7B, respectively. The relative polarity of each vane at the depicted instant of time is indicated by the "+" or "−". The RPMs illustrated are operating in the pi mode and, for that reason, adjacent vanes in the upper and lower planar magnetron sections 108, 110 have polarities that differ by 180 degrees (or pi radians). Thus, a "period" of the EM emission in the pi mode is the amount of space required for the polarity to be repeated. For example, a period is the distance from one vane having a relative polarity of "+" to the next vane having a relative polarity of "+". Likewise, a period is also the distance from one vane having "−" relative polarity to the next vane having a "−" relative polarity. In this case, when the RPM is operating in pi mode, the period length is equal to the width of two vanes and two cavities. In this embodiment, the same number of vanes and cavities are placed on each of the planar magnetron sections 108, 110. During even pi mode operation (FIG. 7A), opposing vanes in the upper planar magnetron 108 section and lower planar magnetron section 110 have the same polarity. For example, vane 114A and vane 114B each have a matching "+" polarity. By contrast, during odd pi mode operation (FIG. 7B), opposing vanes 114 in the upper planar magnetron section 108 and lower planar magnetron section 110 have opposite polarity. For example, vane 114C has a "+" polarity, but vane 114D has a "−" polarity.

In FIG. 8, applied magnetic field is plotted against planar diode voltage (related to the electric field E applied from the cathode 102 to the anode 104 in FIG. 4B) for various modes of RPM operation. The "planar diode voltage" refers to the DC or quasi-DC voltage applied between the cathode and the anode of the RPM. Application of this voltage allows the formation of the DC or quasi-DC electric field E discussed previously. As explained below, this plot demonstrates a number of advantages associated with operating an RPM in the even pi mode over operating the RPM in the odd pi mode.

First, the even pi mode is attainable at lower magnetic fields than is the odd pi mode. This means that an RPM intended to operate in the even pi mode requires less power for electromagnetics or less magnetic material for permanent magnets than would an RPM intended to operate in the odd pi mode. Second, the magnetic field range over which the even pi mode is accessible is much larger than the range over which the odd pi mode is accessible. This means that the system controlling the magnetic field setting for an RPM intended to operate in the even pi mode would require a lower degree of precision than the magnetic field control system for an RPM intended to operate in the odd pi mode. A lower precision control system could be expected to be lower in cost and complexity than one required to provide a higher degree of precision. Lastly, the range of applied magnetic field magnitudes in which the odd pi mode can be accessed also supports undesirable modes, such as the $$\frac{7\pi}{6}$$

mode. This indicates that the operation of the odd pi mode is likely to be less stable than that of the even pi mode. This reduced stability could allow the RPM to more easily start up in a mode other than the odd pi mode or to uncontrollably transition to another mode when originally operating in the odd pi mode.

On the other hand, there are also advantages to operating an RPM in the odd pi mode over operating the RPM in the even pi mode. FIG. 9A illustrates an extracted RPM, where pairs of adjacent cavities 116 are coupled into waveguides 124 via apertures 128 in the cavity walls for extracting microwave energy from the anode 104. The RPM is provided with a mode control cathode 102 and is operating in the even pi mode. As a consequence of operating in the even pi mode, the EM waves 130 within the upper extraction waveguides 124 at this particular instant in time are oriented in a downward direction, whereas the EM waves 132 within the lower extraction waveguides 124 at this particular instant in time are oriented in an upward direction. Thus, EM waves 130 are 180 degrees out of phase with EM waves 132. In this scenario, if the upper and lower waveguides 124 are brought together, the EM waves 130, 132 would partially or completely cancel each other out (i.e., destructively interfere), thereby resulting in an inability to efficiently extract power from the device. This effect is depicted in FIG. 10A, where the EM waves 130, 132 in the upper and lower waveguides 124 are 180 degrees out of phase, which results in no transmitted power in the combined output waveguide 134.

On the other hand, FIG. 9B illustrates an extracted RPM provided with a mode control cathode 102 that is operating in the odd pi mode. As a consequence of operating in the odd pi mode, the EM waves 130 within the upper extraction waveguides 124 at this particular instant in time are oriented in a downward direction, and the EM waves 132 within the lower extraction waveguides 124 at this particular instant in time are also oriented in a downward direction. Thus, EM waves 130 are in phase with EM waves 132. If the upper and lower waveguides are brought together, the waves would combine constructively (i.e., constructive interference) into a combined wave, thereby resulting in efficient power extraction from the device. This effect is depicted in FIG.

10B, where the EM waves 130, 132 in the upper and lower waveguides 124 are in phase and combine constructively to generate combined wave 140. This results in the transmittal of power in the combined output waveguide 134.

As shown above, operating an RPM in the even pi mode is advantageous because it results in increased stability and reduced requirements for the applied magnetic field. However, operation in the odd pi mode is also advantageous because it results in in-phase RF extraction of power from the RPM. Accordingly, what is needed is a recirculating planar magnetron that provides the desirable phase relationship between extracted microwave power in the upper and lower waveguides which is characteristic of operating in the odd pi mode, while also minimizing power requirements and precision control necessary to operate as characterized by operating in the even pi mode.

SUMMARY OF THE INVENTION

The above and other needs are met by an anode for use in a crossed field device operating in a selected mode of operation for generating electromagnetic (EM) emissions. The anode includes a first slow-wave structure having a plurality of first vanes separated by cavities formed therebetween and a second slow-wave structure having a plurality of second vanes separated by cavities formed therebetween. The second vanes are vertically spaced apart from the first vanes to provide a space therebetween. At least one of the first vanes is laterally aligned with one of the second vanes. Furthermore, the first vanes are offset from the second vanes by an offset distance so that at least one of the first vanes is not laterally aligned with a second vane and at least one of the second vanes is not laterally aligned with a first vane. The offset distance is equal to the width of an odd number of half-periods of the electromagnetic (EM) emissions (1 half period, 3 half periods, 5 half periods, etc.) generated in the selected mode of operation. In certain cases, the offset distance is equal to the width of one vane and one cavity. In some cases, the offset distance is sized such that a first vane having a predetermined EM polarity is laterally aligned with a second vane having an equivalent EM polarity.

In certain embodiments, one or more apertures are formed in one or more of the cavities between each of the first and second vanes. The apertures are sized and configured to permit extraction of EM emissions from said cavities. In some cases, extractors are coupled to said apertures to transfer EM emissions away from the anode to an intended load. Additionally, in some cases, each extractor is a waveguide and each waveguide is joined together with at least one other waveguide to form a combined waveguide.

In certain embodiments, the anode includes a short connection member and a long connection member extending outwards from opposing ends of each of the first and second slow-wave structures. The long connection member is longer than the short connection member by a distance equal to the offset distance such that, by joining the short connection member of each slow-wave structure to the long connection member of the opposite slow-wave structure, the first and second slow-wave structure are joined together and the first vanes are offset from the second vanes by the offset distance.

Also disclosed herein is a crossed field device for generating electromagnetic (EM) emissions as the cross product of an electric field (E) and a magnetic field (B), where the crossed field device operates in a selected mode of operation. The crossed-field device first includes generally an anode having a first slow-wave structure having a plurality of first vanes separated by cavities formed therebetween and a second slow-wave structure having a plurality of second vanes separated by cavities formed therebetween. The second vanes are vertically spaced apart from the first vanes to provide a space therebetween. At least one of the first vanes is laterally aligned with one of the second vanes, and the first vanes are offset from the second vanes by an offset distance so that at least one of the first vanes is not laterally aligned with a second vane and at least one of the second vanes is not laterally aligned with a first vane. The device further includes a cathode disposed in the space located between first and second vanes and a magnetic element for generating a magnetic field (B), which is oriented orthogonally to an electric field (E) formed by the anode and cathode to generate EM emissions.

In certain embodiments, the offset distance is equal to the width of an odd number of half-periods of the EM emissions generated in the selected mode of operation. In some embodiments, the offset distance is equal to the width of one vane and one cavity. In some embodiments, the offset distance is sized such that a first vane having a predetermined EM polarity is laterally aligned with a second vane having an equivalent EM polarity. In some embodiments, one or more apertures are formed in one or more of the cavities between each of the first and second vanes, said apertures being sized and configured to permit extraction of EM emissions from said cavities. Furthermore, extractors are coupled to said apertures to transfer EM emissions away from the anode to an intended load. In certain cases, each extractor is a waveguide and each waveguide is joined together with at least one other waveguide to form a combined waveguide.

In some cases, the crossed-field device includes a short connection member and a long connection member extending outwards from opposing ends of each of the first and second slow-wave structures. The long connection member is longer than the short connection member by a distance equal to the offset distance such that, by joining the short connection member of each slow-wave structure is to the long connection member of the opposite slow-wave structure, the first and second slow-wave structure are joined together and the first vanes are offset from the second vanes by the offset distance.

In some cases, the device is configured to operate in pi mode such that the polarity of the EM field in each of the first cavities and each of the second cavities changes by pi radians in each successive cavity.

In certain embodiments, the cathode is a segmented mode control cathode having a plurality of gaps formed in the cathode. In certain cases, the gaps formed in the cathode are centered on the cavities of the first and second slow-wave structures of the anode vanes.

In certain embodiments, the device is configured to operate in even pi mode such that laterally-aligned first and second vanes have an equivalent EM polarity and the polarity of the EM field in each of the first cavities and each of the second cavities changes by pi radians in each successive cavity.

Also disclosed is a method of generating electromagnetic (EM) emissions and for carrying the EM emissions to an intended load. The method including the step of providing a crossed field device having an anode that includes a first slow-wave structure having a plurality of first vanes separated by cavities formed therebetween, and a second slow-wave structure having a plurality of second vanes separated by cavities formed therebetween. The second vanes are vertically spaced apart from the first vanes to provide a space therebetween. The anode further includes one or more apertures formed in the cavities between each of the first and second vanes, said apertures being sized and configured to permit extraction of EM emissions from said cavities. At least one of the first vanes is laterally aligned with one of the second vanes, and the first vanes are offset from the second vanes by an offset distance so that at least one of the first vanes is not laterally aligned with a second vane and at least one of the second vanes is not laterally aligned with a first vane. Extractors are coupled to said apertures to transfer EM emissions away from the anode to an intended load. The device further includes a segmented mode control cathode comprising a plurality of gaps formed in the cathode. The cathode is disposed in the space located between first and second vanes. Lastly, a magnetic element for generating a magnetic field (B) is oriented orthogonally to an electric field (E) formed by the anode and cathode to generate EM emissions. The method also includes the steps of generating EM emissions using the crossed-field device and carrying EM emissions to the intended load via the extractors.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
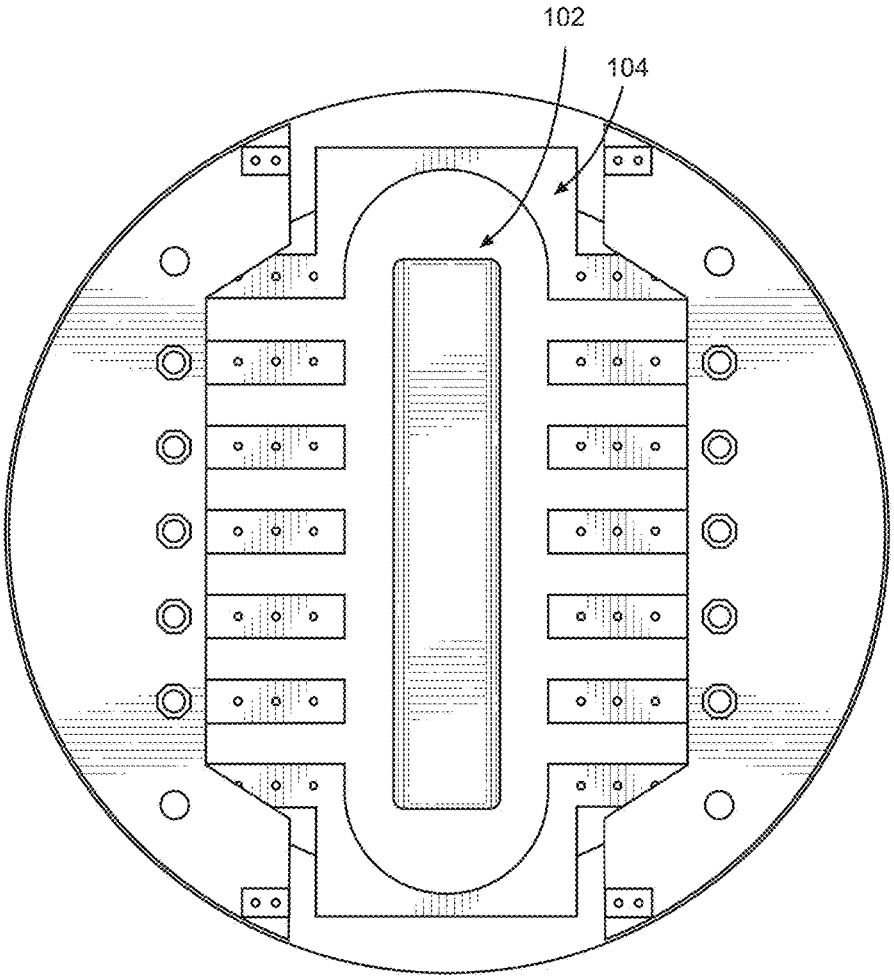
FIGURE 1 (Prior Art)
FIG. 1 is a cross sectional view of an anode and cathode configured for use in a recirculating planar magnetron (RPM)
Figure 11:
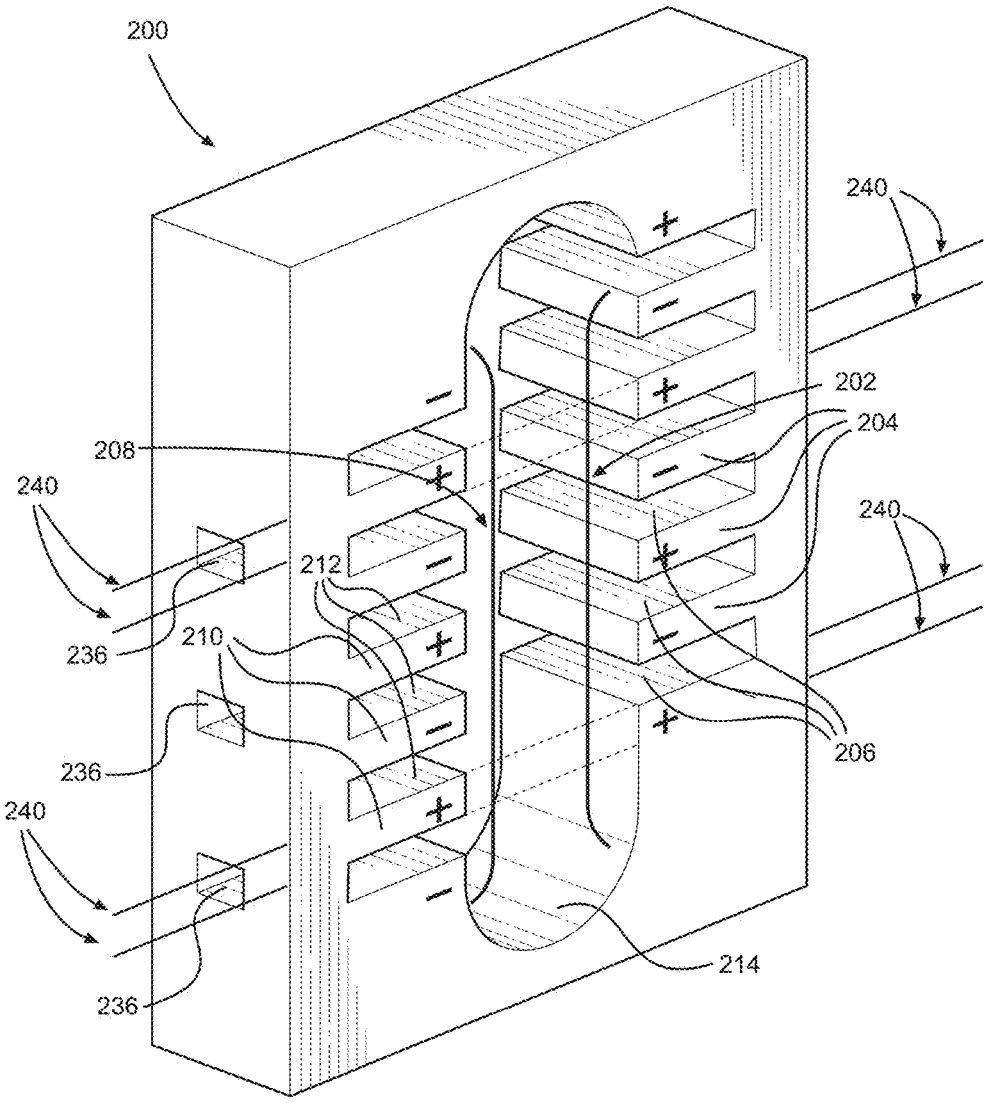
FIG. 11 is a perspective view of an anode for use in a crossed field device operating in a selected mode of operation for generating electromagnetic (EM) emissions according to an embodiment of the present invention.
Figure 12:
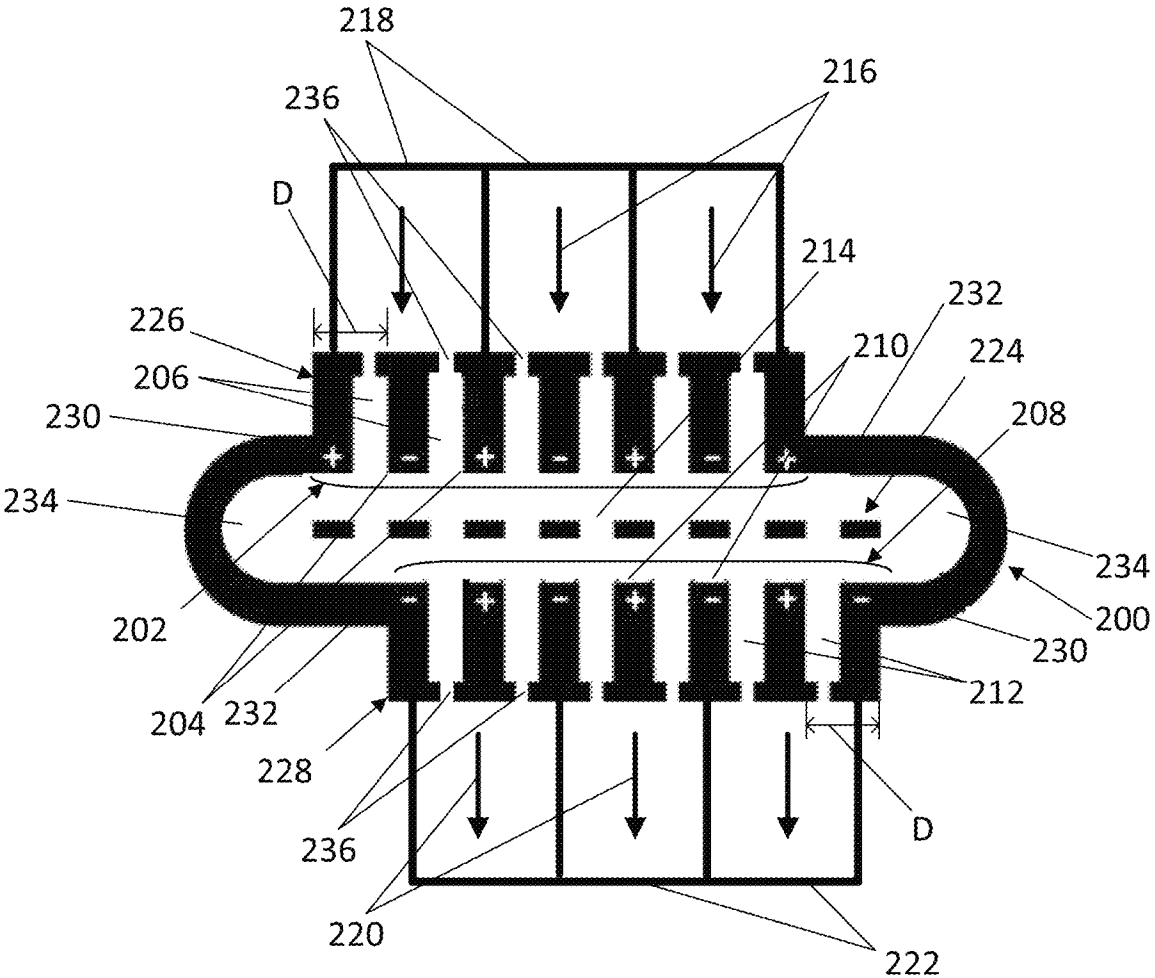
FIG. 12 depicts an extracted RPM having an anode and mode control cathode according to an embodiment of the present invention.

Referring now to the drawings in which like reference characters designate like or corresponding characters throughout the several views, there is shown in FIG. 11 an improved anode 200 for use in a crossed field device operating in a selected mode of operation for generating electromagnetic (EM) emissions according to a first embodiment of the present disclosure. The anode 200 includes generally a first slow-wave structure 202 having a plurality of first vanes 204 separated by cavities 206 formed therebetween and a second slow-wave structure 208 having a plurality of second vanes 210 separated by cavities 212 formed therebetween. The second vanes 210 are spaced apart from the first vanes 204 to provide a space 214 therebetween. As shown in FIG. 12, that space 214 is suitably sized for a cathode 224. Although five vanes 204, 210 are illustrated on the slow-wave structures 202, 208, this is not intended to be limiting of the disclosed inventions. For example, any number of vanes 204, 210 could be provided depending on the application and desired output. In addition, there may be more or less vanes 204, 210 provided in one slow-wave structure as compared with the opposite slow-wave structure, depending on the application and desired output As in the prior art anodes 104 (FIG. 1) discussed above, the anode 200 includes at least one first vane 204 that is laterally aligned with one of the second vanes 210. This positional relationship is shown by solid and dashed lines 240 extending laterally across the anode 200 in FIG. 11. However, unlike the prior art anodes discussed above, the first vanes 204 of this anode 200 are laterally offset from the second vanes 210 by an offset distance D so that at least one of the first vanes is not laterally aligned with a second vane and at least one of the second vanes is not laterally aligned with a first vane.

In this particular case, the offset distance D is equal to one period of the slow wave structures 204, 208 or the width of one cavity 206, 212 and one vane 204, 210. Put another way, the offset distance D is equal to the width of one half-period of the EM emissions generated in the selected mode of operation. Since, in this case when operating in pi mode, two cavities and two vanes are required for the polarity of the EM emission to repeat with the slow wave structure of this anode 200, the width of a half period is equal to the width of one cavity 206, 212 and one vane 204, 210. However, in other embodiments, the offset distance may be increased to any odd number of half-periods of the EM emissions generated in the selected mode of operation. In each case, the lateral shift may be performed in either direction. For example, as shown, the lower planar magnetron section 208 is shifted to the right by one period, with respect to the upper planar magnetron section 202. The anode 200 would also function as intended if the lower planar magnetron section 208 was shifted to the left by one period, with respect to the upper planar magnetron section 202.

Figure 9A:
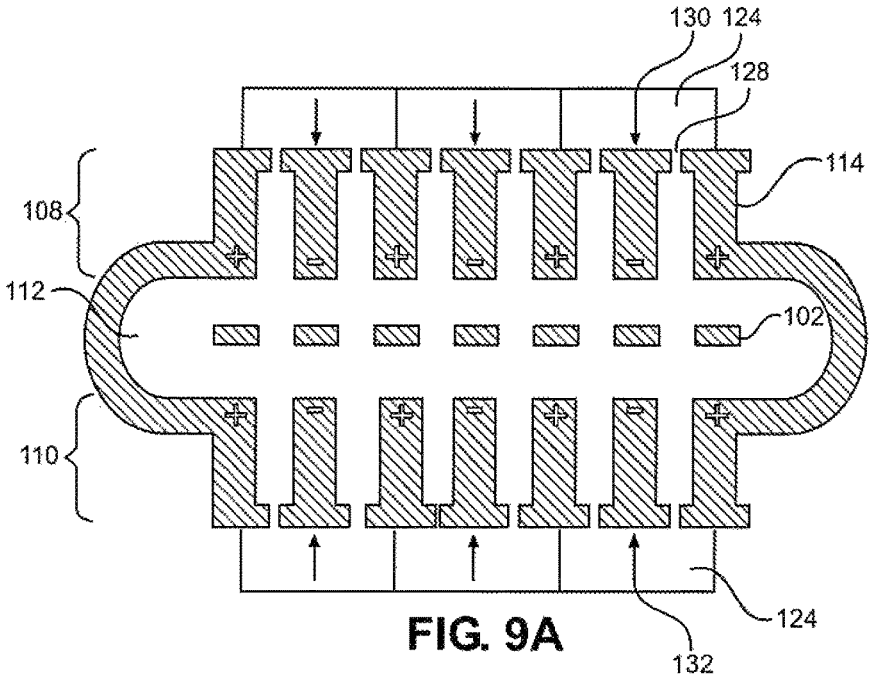
FIGS. 9A and 9B depict an extracted RPM operating in even and odd pi modes, respectively.
Figure 9B:
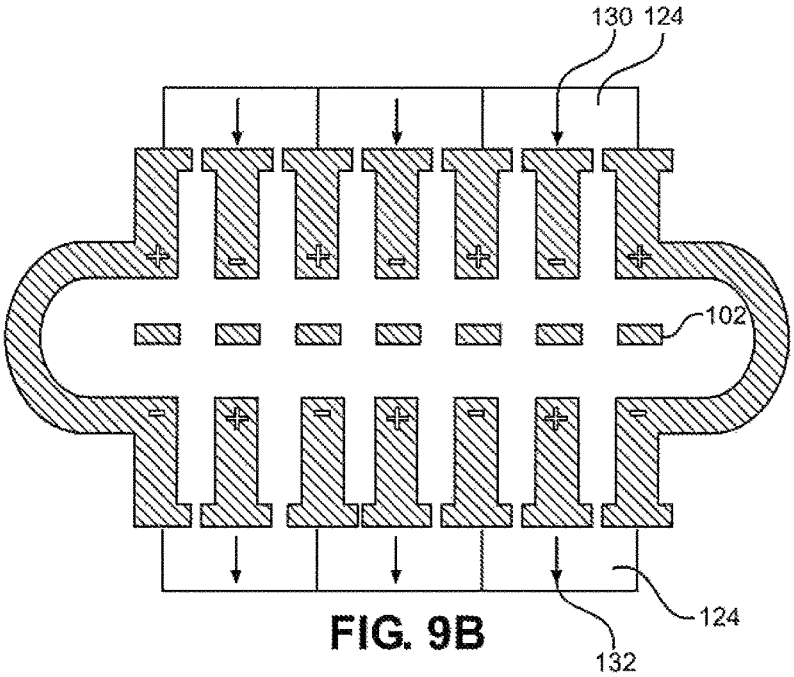
Figure 10A:
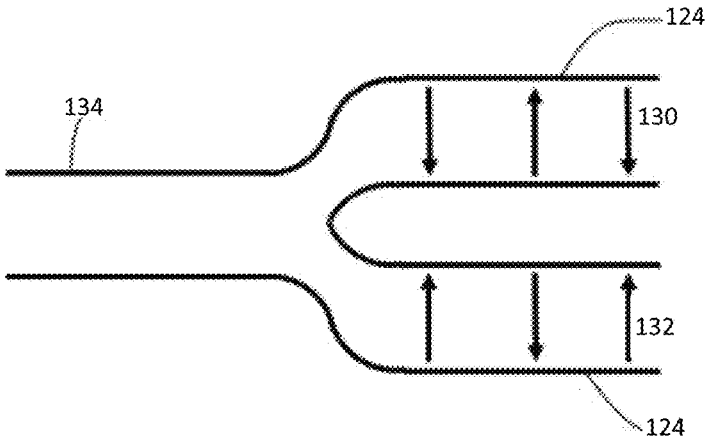
FIGS. 10A and 10B depict separate waveguides joined together in a combined waveguide, where the EM waves are out of phase and in phase with one another, respectively.
Figure 10B:
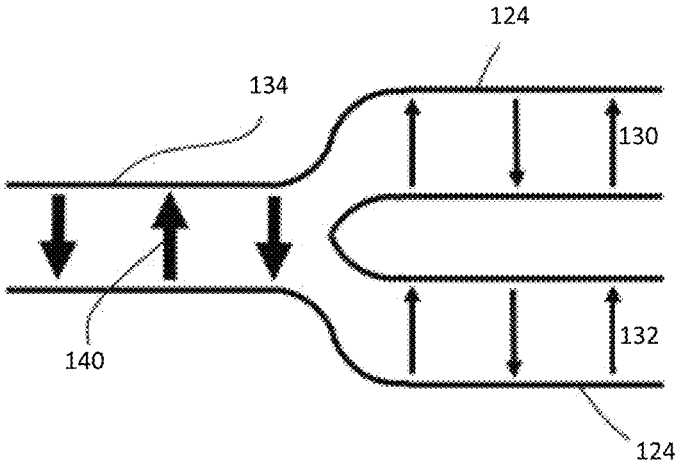

At the instant in time represented by FIG. 12, the RF electromagnetic field configuration would result in EM waves 216 oriented in a downward direction within the upper extraction waveguides 218 and EM waves 220 oriented in a downward direction within the lower extraction waveguide 222. In this regard, this RPM configuration is similar to the RPM illustrated in FIG. 9B, where the EM waves 130, 132 were each oriented in the same direction. As discussed above, having EM waves 216, 220 oriented in the same direction is important because it enables EM energy to be extracted and then constructively combined, thereby resulting in the transmittal of power in the output waveguide to the intended load, as shown in FIG. 10B.

Figure 7A:
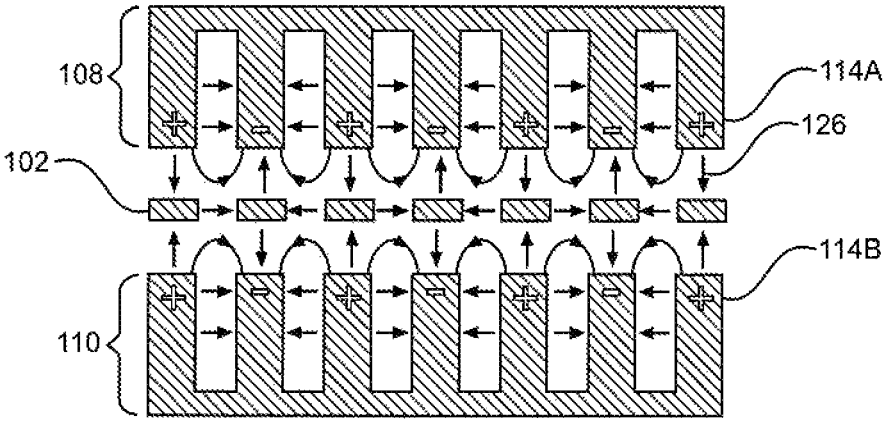
FIGS. 7A and 7B depict an RPM operated in even and odd pi modes and including RF electric field lines resulting from those modes of operation.
Figure 7B:
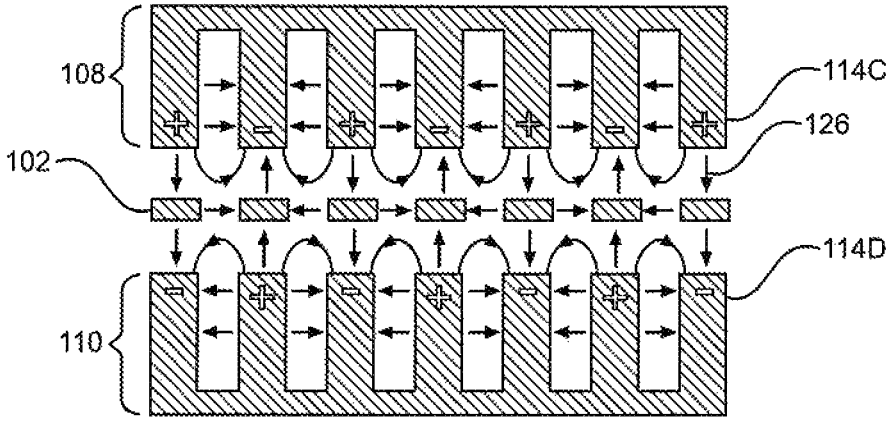
Figure 8:
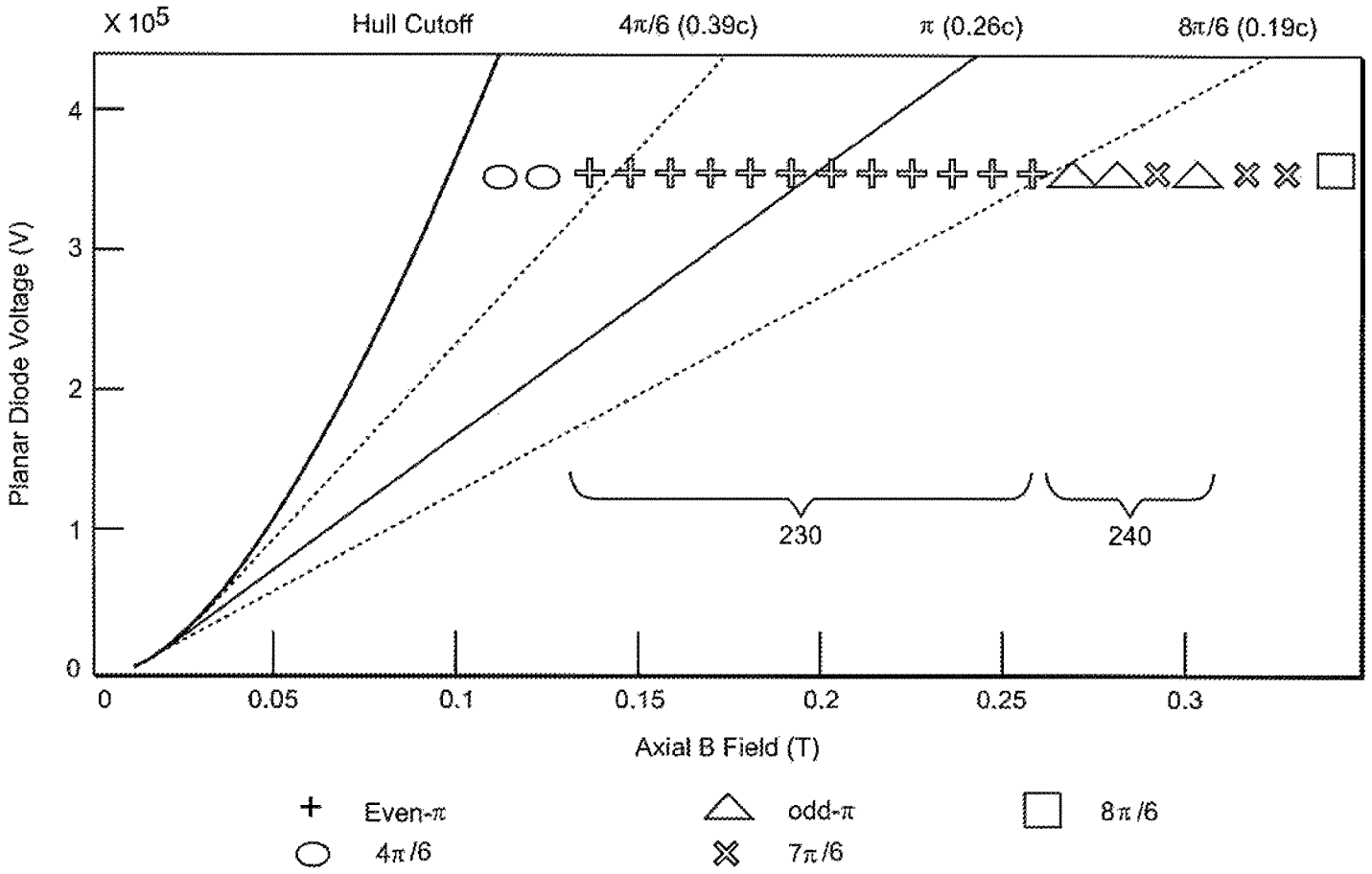
FIG. 8 is a plot of the operating space of the even and odd pi modes for an RPM.

As discussed above, however, in order to achieve EM waves that are each oriented in the same direction, use of the odd pi mode was necessary. Recall that during odd pi mode operation (FIG. 7B), opposing vanes 114C, 114D in the upper planar magnetron section 108 and lower planar magnetron section 110 have opposite polarity. Likewise, in the embodiment illustrated in FIG. 12, the left-most vane 226 of the upper magnetron section 202 has a "+" polarity and the left-most vane 228 of the lower magnetron section 208 has a "−" polarity. Therefore, this structure is similar to the RPM in FIG. 7B that is operating in odd pi mode. Therefore, if the upper and lower planar magnetron sections 202, 208 were not shifted by the offset distance D, this structure would result in the same structure shown previously in FIG. 9B and would have the same disadvantages of that structure.

However, the first vanes 204 are offset from the second vanes 210 by an offset distance D equal to the width of one cavity and one vane. This shift results in the relative polarity on opposing (i.e., laterally aligned) vanes 204, 210 at the instant in time represented being equal, such that the shifted RPM is operating in the even pi mode. Recall from FIG. 9A that operating in the even pi mode results in opposing vanes having like charge at a given instant in time. This means that the shifted RPM shown in FIG. 12 will benefit from the aforementioned beneficial operating properties of the even pi mode, such as lower magnetic field requirements and enhanced mode stability.

Shifting the upper and lower planar magnetron sections with respect to one another requires the recirculation sections 234 to be altered to maintain the electromagnetic connection between the shifted planar magnetron sections. In particular, after laterally shifting the magnetron sections 202, 208 with respect to one another one, one side of each of the recirculation sections 234 is longer than the other in order to accommodate this shift. Accordingly, the anode includes a short connection member 230 and a long connection member 232 extending outwards from opposing ends of each of the upper magnetron section 202 and the lower magnetron section 208. In FIG. 12, the connection members 230, 232 are located on the left-most and right-most ends of the upper magnetron section 202 and the lower magnetron section 208. Each of the long connection members 232 is longer than the short connection members 230 by a distance equal to the offset distance D. Thus, by joining the short connection member 230 of each slow-wave structure to the long connection member 232 of the opposite slow-wave structure, the first and second slow-wave structures 202, 208 are joined together and the first vanes 204 are offset from the second vanes 210 by the offset distance D.

The anode 200 is provided with one or more apertures 236 formed in one or more of the cavities 206, 212 between each of the first and second vanes 204, 210. The apertures are sized and configured to permit extraction of EM emissions from the cavities 206, 212. Extraction waveguides 218, 222 are coupled to each of the apertures 236 for transferring EM emissions away from the anode 200 to an intended load. Preferably, the separate waveguides are joined together with at least one other waveguide to form a combined waveguide. Due to the preferred phase relationship of the RF power in the upper and lower waveguides 218, 222, the EM waves traveling into the combined waveguide would combine constructively (i.e., constructive interference), thereby resulting in efficient power extraction from the device. This is illustrated, for example, in FIG. 10B. While the apertures 236 are depicted to all be the same, in practice, a given aperture or set of apertures may differ from adjacent apertures or sets of apertures in size and geometry. This alteration of aperture size is sometimes done for the purposes of power balancing between waveguides, but would not inhibit the functionality of the present invention.

Figure 13:
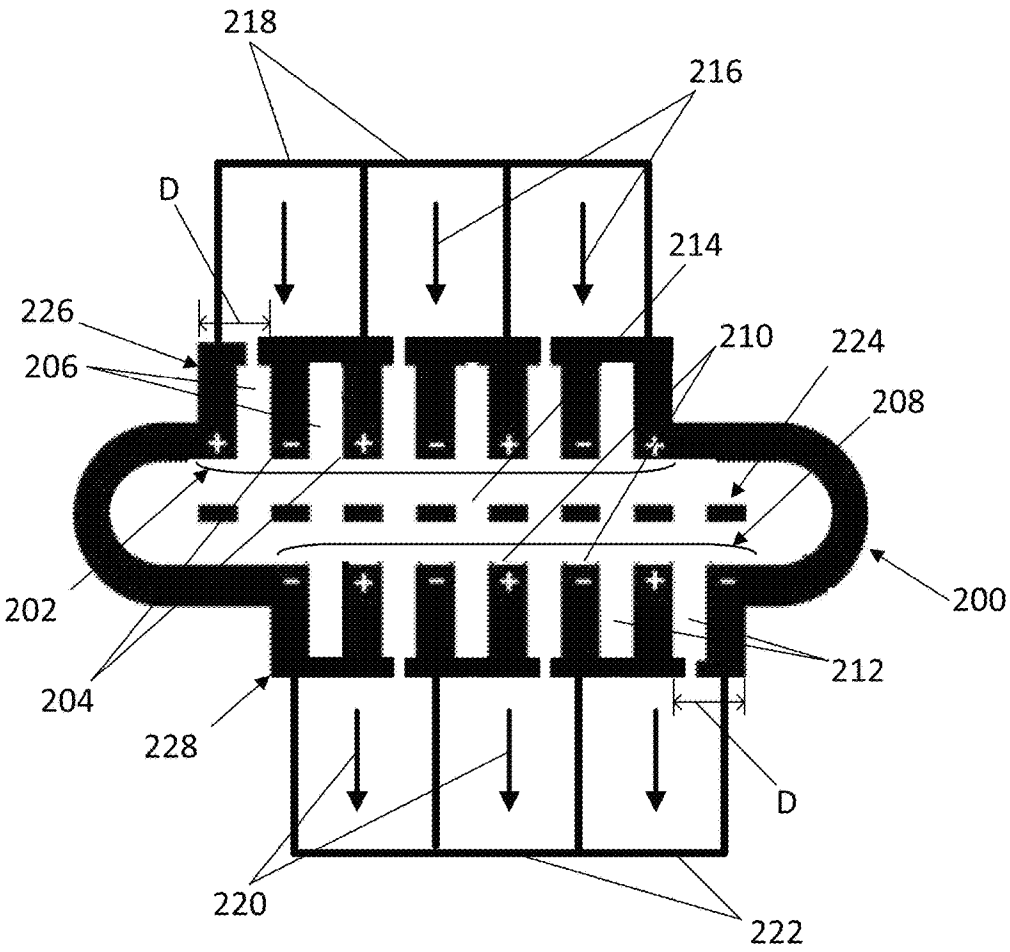
FIG. 13 depicts the RPM of FIG. 12 after apertures in the anode have been blocked off.
Figure 14:
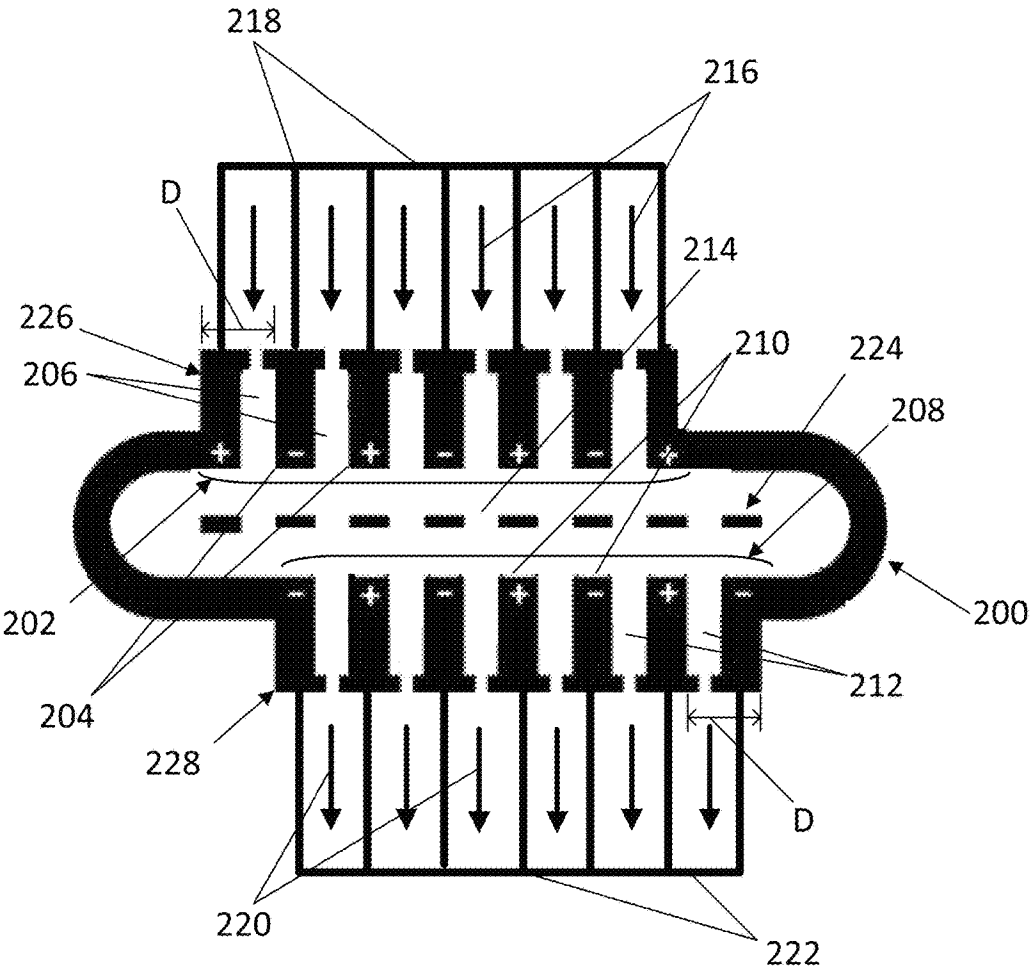

Additionally, as illustrated in FIG. 13, pi mode operation and waveguide extraction could be accomplished in the case where only every other adjacent cavity includes an aperture connected to an extraction waveguide.

Figure 2:
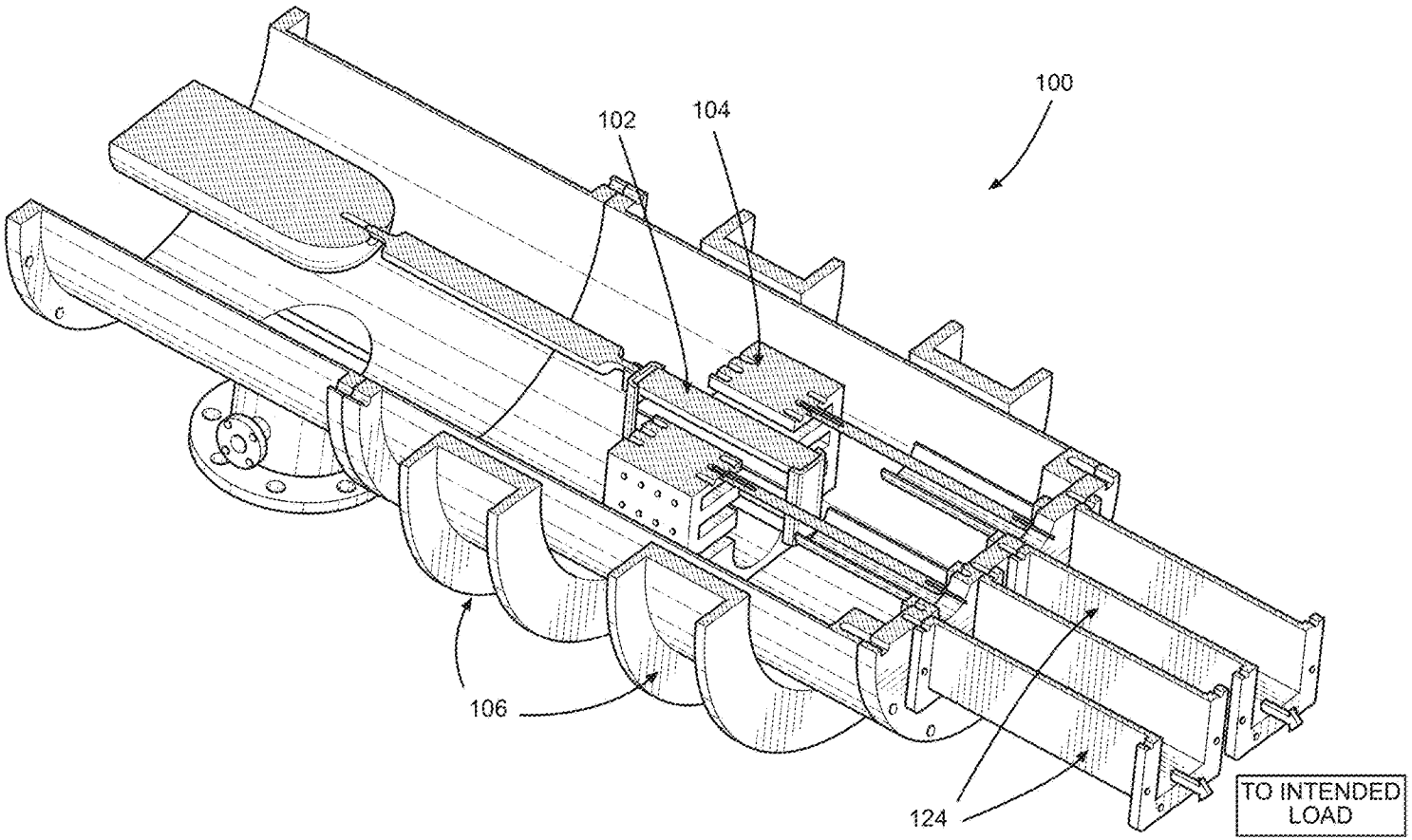
FIGURE 2 (Prior Art)
FIG. 2 is a cutaway perspective view of an RPM having an anode and cathode installed.
Figure 3:
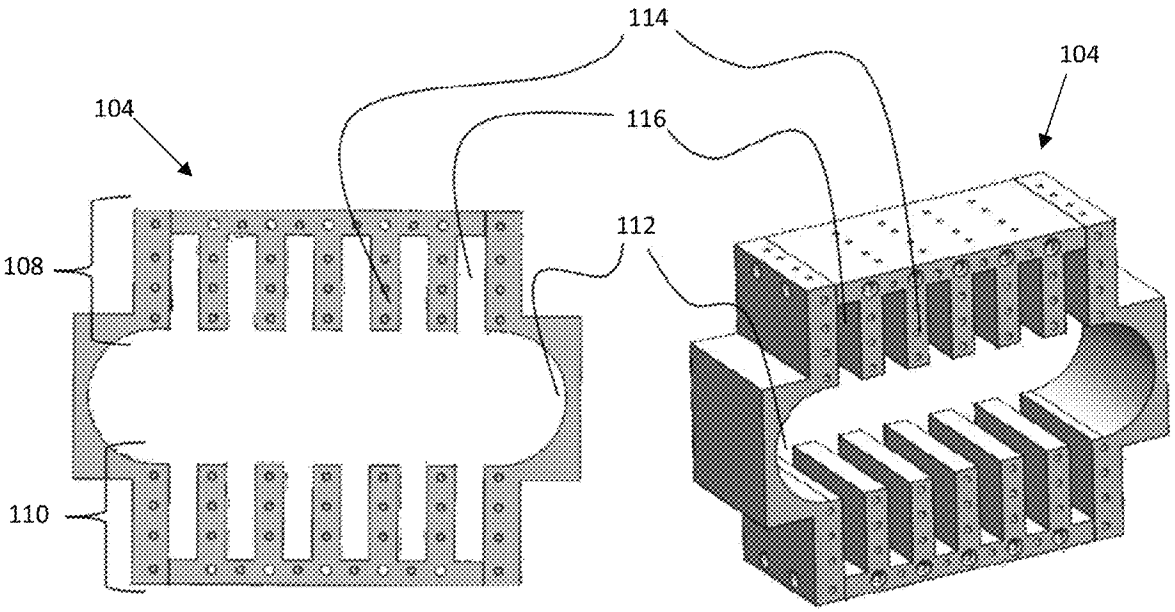
FIGURE 3 (Prior Art)
FIG. 3 depicts a front elevation view and a perspective view of an anode.
Figure 4A:
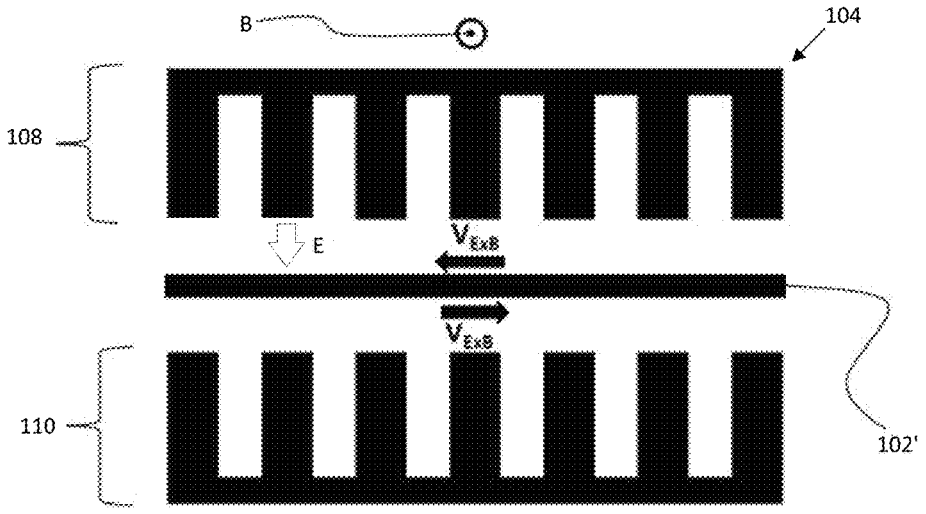
FIGURE 4A (Prior Art)
FIG. 4A is a sectional view of a portion of an anode and a solid cathode.
Figure 4B:
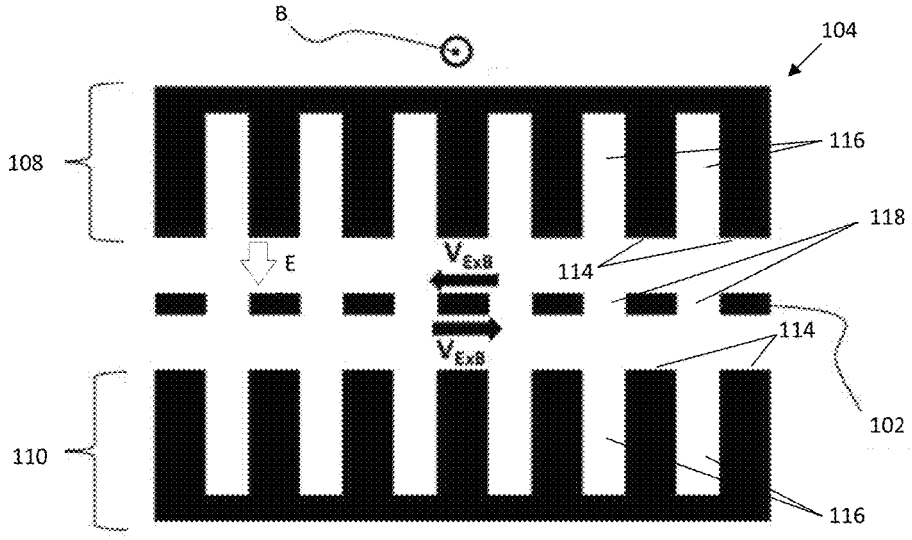
FIGURE 4B (Prior Art)
FIG. 4B is a sectional view of a portion of an anode and a segmented or "mode control" cathode.
Figure 5:
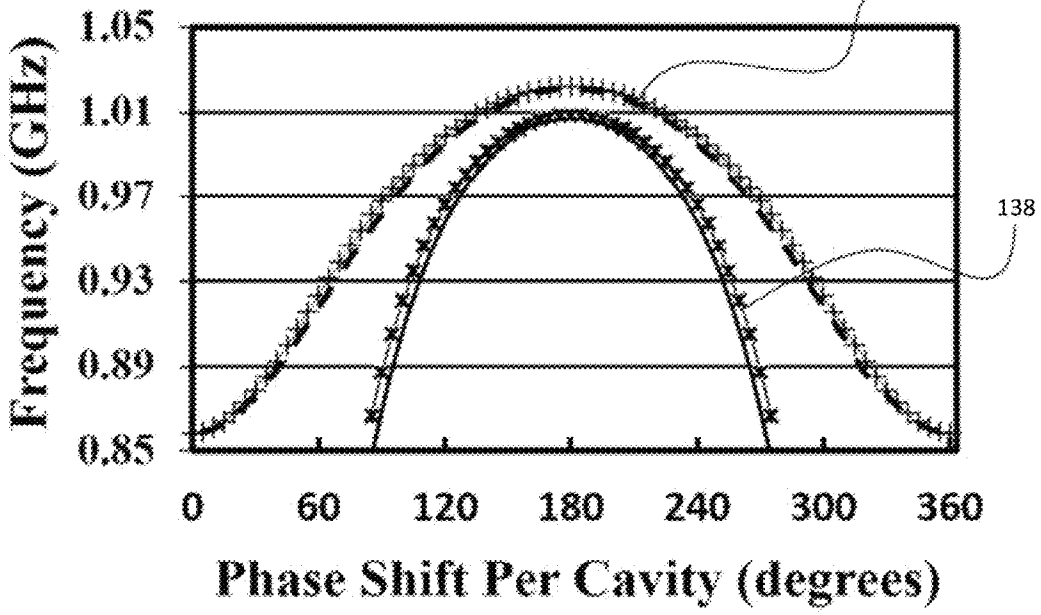
FIGURE 5 (Prior Art)
FIG. 5 shows dispersion plots of an RPM having a mode control cathode in even and odd modes.
Figures 6A, 6B, 6C:
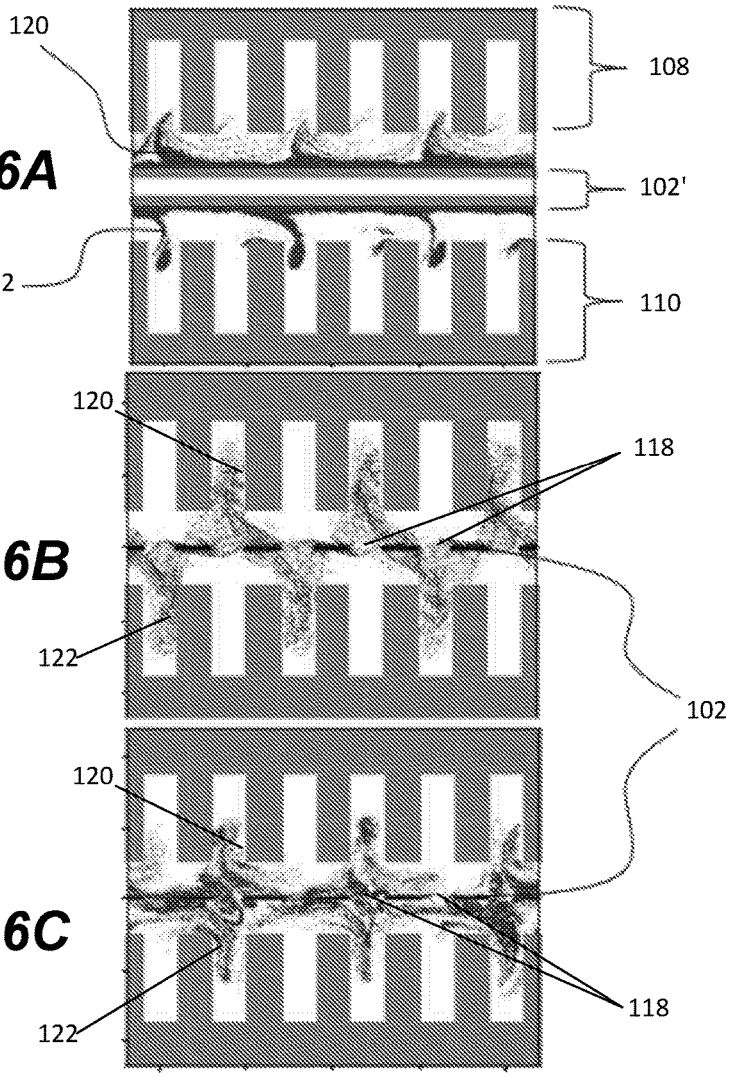
FIGURE 6C (Prior Art)
FIG. 6A depicts an RPM having a solid cathode and operating in pi mode.
FIGS. 6B and 6C depict an RPM having a mode cathode and operating in even and odd pi modes, respectively.

The device illustrated in FIG. 2 includes a coaxial waveguide. The improved anode 200 of the present invention could be used as a substitute for anode 104. Additionally, the anode 200 would also work for non-coaxial waveguides as well. The cross section of non-coaxial waveguides may be rectangular, elliptical, or other more complex shapes in cross section. The waveguides may include internal structures such as single ridge structures, double ridge structures, or more complex structures. The anode 200 disclosed herein would be expected to function as intended when using any non-coaxial waveguide regardless of its cross section.

Thus, as illustrated above, the anode design disclosed herein gains the preferred phase relationship of the RF power in the upper and lower waveguides, generally associated with the odd pi mode, while operating in the even pi mode. The anode 200 and cathode 224 discussed above may be substituted for the anode 104 and cathode 102 installed in the RPM 100 shown in FIG. 2.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the invention in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An anode for use in a crossed field device operating in a selected mode of operation for generating electromagnetic (EM) emissions, the anode comprising: a first slow-wave structure having a plurality of first vanes separated by cavities formed therebetween; and a second slow-wave structure having a plurality of second vanes separated by cavities formed therebetween, the second vanes being vertically spaced apart from the first vanes to provide a space therebetween, wherein at least one of the first vanes is laterally aligned with one of the second vanes, and wherein the first vanes of plurality of first vanes are offset from the second vanes of the plurality of second vanes by an offset distance so that said at least one of the first vanes is not laterally aligned with a different second vane and at least one of the second vanes is not laterally aligned with a different first vane.

2. The anode of claim 1 wherein the offset distance is equal to the width of an odd number of half-periods of the electromagnetic (EM) emissions generated in the selected mode of operation.

3. The anode of claim 1 wherein the offset distance is equal to the width of one vane and one cavity.

4. The anode of claim 1 wherein the offset distance is sized such that a first vane having a predetermined EM polarity is laterally aligned with a second vane having an equivalent EM polarity.

5. The anode of claim 1 further comprising one or more apertures formed in one or more of the cavities between each of the first and second vanes, said apertures being sized and configured to permit extraction of EM emissions from said cavities.

6. The anode of claim 5 further comprising extractors coupled to said apertures to transfer EM emissions away from the anode to an intended load.

7. The anode of claim 6 wherein each extractor is a waveguide and each waveguide is joined together with at least one other waveguide to form a combined waveguide.

8. The anode of claim 1 further comprising a short connection member and a long connection member extending outwards from opposing ends of each of the first and second slow-wave structures, wherein the long connection member is longer than the short connection member by a distance equal to the offset distance such that, by joining the short connection member of each slow-wave structure to the long connection member of the opposite slow-wave structure, the first and second slow-wave structure are joined together and the first vanes are offset from the second vanes by the offset distance.

9. A crossed field device for generating electromagnetic (EM) emissions as the cross product of an electric field (E) and a magnetic field (B), the crossed field device operating in a selected mode of operation and comprising: an anode comprising:

a first slow-wave structure having a plurality of first vanes separated by cavities formed therebetween;

a second slow-wave structure having a plurality of second vanes separated by cavities formed therebetween, the second vanes being vertically spaced apart from the first vanes to provide a space therebetween, wherein at least one of the first vanes is laterally aligned with one of the second vanes, and wherein the first vanes of plurality of first vanes are offset from the second vanes of plurality of second vanes by an offset distance so that said at least one of the first vanes is not laterally aligned with a different second vane and at least one of the second vanes is not laterally aligned with a different first vane;

a cathode disposed in the space located between first and second vanes; and a magnetic element for generating a magnetic field (B), which is oriented orthogonally to an electric field (E) formed by the anode and cathode to generate EM emissions.

10. The crossed-field device of claim 9 wherein the offset distance is equal to the width of an odd number of half-periods of the EM emissions generated in the selected mode of operation.

11. The crossed-field device of claim 9 wherein the offset distance is equal to the width of one vane and one cavity.

12. The crossed-field device of claim 9 wherein the offset distance is sized such that a first vane having a predetermined EM polarity is laterally aligned with a second vane having an equivalent EM polarity.

13. The crossed-field device of claim 9 further comprising:

one or more apertures formed in one or more of the cavities between each of the first and second vanes, said apertures being sized and configured to permit extraction of EM emissions from said cavities;

extractors coupled to said apertures to transfer EM emissions away from the anode to an intended load.

14. The crossed-field device of claim 13 wherein each extractor is a waveguide and each waveguide is joined together with at least one other waveguide to form a combined waveguide.

15. The crossed-field device of claim 9 further comprising a short connection member and a long connection member extending outwards from opposing ends of each of the first and second slow-wave structures, wherein the long connection member is longer than the short connection member by a distance equal to the offset distance such that, by joining the short connection member of each slow-wave structure is to the long connection member of the opposite slow-wave structure, the first and second slow-wave structure are joined together and the first vanes are offset from the second vanes by the offset distance.

16. The crossed field device of claim 9 wherein the device is configured to operate in pi mode such that the polarity of the EM field in each of the first cavities and each of the second cavities changes by pi radians in each successive cavity.

17. The crossed field device of claim 9 wherein the cathode is a segmented mode control cathode comprising a plurality of gaps formed in the cathode.

18. The crossed field device of claim 17 wherein the gaps formed in the cathode are centered on the cavities of the first and second slow-wave structures of the anode vanes.

19. The crossed field device of claim 17 wherein the device is configured to operate in even pi mode such that laterally-aligned first and second vanes have an equivalent EM polarity and the polarity of the EM field in each of the first cavities and each of the second cavities changes by pi radians in each successive cavity.

20. A method of generating electromagnetic (EM) emissions and for carrying the EM emissions to an intended load, the method comprising the steps of: providing a crossed field device comprising: an anode comprising a first slow-wave structure having a plurality of first vanes separated by cavities formed therebetween; a second slow-wave structure having a plurality of second vanes separated by cavities formed therebetween, the second vanes being vertically spaced apart from the first vanes to provide a space therebetween; one or more apertures formed in the cavities between each of the first and second vanes, said apertures being sized and configured to permit extraction of EM emissions from said cavities; wherein at least one of the first vanes is laterally aligned with one of the second vanes, and wherein the first vanes of plurality of first vanes are offset from the second vanes of plurality of second vanes by an offset distance so that said at least one of the first vanes is not laterally aligned with a different second vane and at least one of the second vanes is not laterally aligned with a different first vane; extractors coupled to said apertures to transfer EM emissions away from the anode to an intended load;

a segmented mode control cathode comprising a plurality of gaps formed in the cathode, the cathode disposed in the space located between first and second vanes; and a magnetic element for generating a magnetic field (B) that is oriented orthogonally to an electric field (E) formed by the anode and cathode to generate EM emissions; generating EM emissions using the crossed-field device; and carrying EM emissions to the intended load via the extractors.

* * * * *